US005624712A

United States Patent [19]

Shulman

[11] Patent Number: 5,624,712

[45] **Date of Patent: *Apr. 29, 1997**

[54] LIQUID FATTY ACID PROTECTION OF ANODIZED ALUMINUM

[75] Inventor: Garson P. Shulman, Torrance, Calif.

[73] Assignee: Alumitec Products Corp., Sierra Madre, Calif.

[ * ] Notice: The term of this patent shall not extend beyond the expiration date of Pat. No. 5,169,458.

[21] Appl. No.: 488,805

[22] Filed: Jun. 8, 1995

Related U.S. Application Data

[62] Division of Ser. No. 367,555, Feb. 21, 1995, which is a continuation of Ser. No. 146,533, Nov. 2, 1993, abandoned.

[51] Int. Cl.[6] ..... B05D 3/00

[52] U.S. Cl. ..... 427/327; 427/405; 427/430.1; 148/248; 148/251; 148/252; 148/272; 148/274; 148/275

[58] Field of Search ..... 427/327, 405, 427/430.1; 148/248, 251, 252, 272, 274, 275; 428/472.2; 205/201, 202, 203, 204, 210, 211

[56] References Cited

U.S. PATENT DOCUMENTS

| | | | |
|---|---|---|---|
| 5,169,458 | 12/1992 | Shulman et al. | 148/248 |
| 5,226,976 | 7/1993 | Carlson et al. | 148/257 |

*Primary Examiner*—Shrive Beck
*Assistant Examiner*—David M. Maiorana
*Attorney, Agent, or Firm*—Louis J. Bachand

[57] ABSTRACT

Aluminum surfaces are protected with increased corrosion resistance by anodize, and sealing with a liquid fatty acid free of flammable solvents, suitably in the presence of a heterocyclic aromatic azole treating agent where the aluminum surface is of a copper containing aluminum alloy.

22 Claims, No Drawings

LIQUID FATTY ACID PROTECTION OF ANODIZED ALUMINUM

This is a divisional of application Ser. No. 08/367,555 filed on Feb. 21, 1995, which is in turn a continuation of Ser. No. 08/146,533 filed on Nov. 2, 1993, now abandoned.

TECHNICAL FIELD

This invention relates to corrosion protection of aluminum, including aluminum alloys with copper, and more particularly to the protection of aluminum by anodize and the application of sealing amounts of fatty acid onto the anodized aluminum surface, at ambient temperatures, and freely of the use of solvents for the fatty acid.

BACKGROUND

Aluminum alloys with copper, e.g. the Series 1000, 2000 and 7000 aluminum alloys, are extensively used in architectural, aircraft and marine applications, and as such are desirably improved in corrosion resistance without adverse trade-offs such as increased weight or discoloration. At the same time, increasing environmental concerns dictate that improvements be obtained without undue use of environmentally hazardous chemicals in anodizing, such as chromates.

In U.S. Pat. No. 5,169,548 to Shulman and Bauman, improvements in corrosion resistance of aluminum were obtained by conditioning a freshly anodized aluminum surface with alcohol and treating with a fatty acid. Corrosion resistance to as much as 2856 hours was obtained using stearic acid and isopropyl alcohol. This technique avoided the problems inherent in use of highly heated baths of fatty acid for this purpose as previously taught, e.g. in U.S. Pat. No. 4,130,466 to Kramer.

Industrial scale application of fatty acid sealing with the use of an alcohol solvent raises concerns of fire hazard, when conducted indoors, and there is need to obtain the benefits of fatty acid sealing of aluminum surfaces without the flammability difficulties accompanying use of an organic solvent for the fatty acid.

DESCRIPTION OF THE INVENTION

It has now been discovered that the benefits of the fatty acid sealing of anodized aluminum are obtainable without the use of organic solvents previously thought necessary.

It is an object therefore of the present invention to further improve the corrosion resistance of aluminum by anodizing and sealing, and without the use of organic solvents, or baths of highly heated fatty acid. It is another object to effect these improvements on aluminum alloys with copper. It is another object to employ an azole treating agent in combination with anodize and solvent-free fatty acid treatments of aluminum copper alloy surfaces.

These and other objects of the invention to become apparent hereinafter are realized by the use of a liquid fatty acid, e.g. branched isostearic acid as the fatty acid sealing agent.

More particularly, the invention provides a method of increasing the resistance to corrosion of an anodized aluminum surface, including applying to the surface in freshly anodized condition sealing amounts of a fatty acid which is liquid at application temperatures, the application temperatures ranging from about 15° to 35° C.

The term "freshly anodized condition" herein refers to an anodized aluminum surface which can be improved in corrosion resistance by application of sealing amounts of liquid fatty acid. An aluminum surface remains in freshly anodized condition for an hour up to 18 hours following anodizing or longer where precautions are taken to protect the surface and maintain its readiness for fatty acid application.

In the invention method, there is further included selecting a copper containing aluminum alloy of the 1000, 2000, or 7000 series, anodizing the aluminum surface to an anodize layer thickness of 0.2 to 0.6 mils, making the fatty acid application within 18 hours of anodizing, applying the fatty acid onto the aluminum surface by spraying, coating or dipping, having the fatty acid 100% fatty acid solids when applied, having the fatty acid free of organic solvents of higher flammability than the acid when applied, and selecting branched, i.e. branch chained isostearic acid as the fatty acid.

In a preferred embodiment, the invention provides a method of protecting copper alloys of aluminum against surface corrosion, including anodizing the aluminum surface to be protected, treating the surface with a heterocyclic aromatic azole treating agent having up to 16 carbon atoms before, during or after the anodizing Step, and coating the treated surface after anodize at temperatures between about 15° and 35° C. with a liquid fatty acid.

In this and like embodiments, the invention includes selecting benzotriazole as the treating agent, treating the aluminum surface with a solution of the treating agent in the liquid fatty acid, maintaining from 0.1% to 10% by weight treating agent in the liquid fatty acid, treating the anodized surface with an organic solution of the treating agent after the anodizing step, simultaneously treating the anodized surface with treating agent and coating the surface with the liquid fatty acid, the treating agent being in solution in the liquid fatty acid, and selecting as the treating agent benzotriazole and as the liquid fatty acid branched isostearic acid, the treating agent being present in an amount between 0.1% by weight and saturation.

The invention further provides a method of protecting series 1000, 2000 and 7000 copper-containing alloys of aluminum against surface corrosion, including applying a liquid fatty acid thereto in sealing amounts, the surface being previously or simultaneously treated with a heterocyclic aromatic azole treating agent having up to 16 carbon atoms.

In this and like embodiments, typically, the liquid fatty acid is branched isostearic acid, and the treating agent is benzotriazole and is present in an amount between 0.1% and 10% by weight, and the aluminum surface anodize coat thickness is between 0.2 and 0.6 mils.

The invention further contemplates the products of the foregoing methods.

BEST MODE FOR CARRYING OUT THE INVENTION

Operating conditions are not narrowly critical. No special temperatures, atmospheres, or handling techniques are required, with ambient temperatures being useful in the present invention through the use of liquid fatty acid. Conventional anodizing techniques and electrolytes can be used, with sulfuric acid baths, suitably with oxalic or other like acid added as well to prevent burn. Anodized oxide coat thicknesses after anodize are typically but not critically in the range of 0.2 to 0.6 mil. Where present, the amount of heterocyclic aromatic azole treating agent in the anodize bath should be about 1% ±0.5 sufficient to incorporate an effective amount of the treating agent in the anodize coating.

The application of liquid fatty acid is preferably by dipping, brushing, coating or spraying depending upon equipment available, the size and shape of the part and the presence or not of hidden surfaces to be coated. As noted the liquid fatty acid is preferably applied as 100% solids and free of solvents, particularly solvents having a greater flammability than the acid used. The quantity of fatty acid coating is not narrowly critical, but should be the minimum effective amount improving the corrosion resistance of the surface over the corrosion resistance obtained from anodize alone. The quantity of heterocyclic aromatic azole treating agent also is not narrowly critical, and should be an effective amount enhancing the corrosion resistance of the surface over that obtained from the use of anodize and/or liquid fatty acid coating alone.

The preferred fatty acid is liquid branched isostearic acid. Other fatty acids having from 5 to 24 carbon atoms and liquid under application conditions and at application temperatures between 15° and 35° C. may be used particularly in combination with the branched isostearic acid.

The preferred heterocyclic aromatic azole treating agent is benzotriazole. Other heterocyclic aromatic azoles which can be used include: benzoxazole, benzotriazole-5-carboxylic acid, benzimidazole, 2-mercapto-5-methyl benzimidazole, 2-mercaptoimidazole, and benzothiazole.

The alloys usefully processed in accordance with the present invention are the alloys of aluminum, particularly aluminum alloys with copper and other elements wherein copper is the second largest component of the alloy. Series 1000, 2000 and 7000 aluminum alloys are effectively treated, particularly those with from 0.2 to 7 per cent by weight copper content.

As noted above, the invention provides methods for greatly enhancing the corrosion resistance of aluminum alloys with copper by use of a heterocyclic aromatic azole treating agent.

While not wishing to be bound to any particular theory as to the reasons for the noted efficacy of treating aluminum alloys with copper with heterocyclic aromatic azole treating agent such as benzotriazole, in aircraft structural alloys, such as 2024 T-3 in which copper is the principal alloying ingredient (copper 4.5%, Mg 1.5% and Mn 0.5%), anodizing forms copper-rich nanophases at the base metal/barrier layer interface. These nonstoichiometric phase boundary artifacts occur in debris fields of slip dislocations. These anomalous regions can significantly degrade both the corrosion and the fatigue resistance of anodized alloys. Corrosion results from anodic coupling of e.g. cathodic copper- rich areas to the base metal. Fatigue resistance degradation is due to mechanical fracturing and slipping at boundary layer/base metal interface. A sharp increase in corrosion or fatigue resistance should result in anodized systems if nonaluminum nanophases can be isolated from galvanic interaction with the surrounding base metal. In the present invention the azoles may sequester nonaluminum phases in the base metal/barrier layer interface and block anodic coupling, i.e. corrosion, between the base metal and other alloy constituents. The anodized oxide layer above this region is sealed with an ionogenic fatty acid sealant to prevent entry of corrosives into the barrier layer region. The invention thus provides a novel duplex means of increasing the corrosion resistance of structural aluminum alloys, by forming two chemically distinct, but interactive types of corrosion barriers.

EXAMPLES

The invention will be illustrated by the following examples wherein all parts are by weight to volume unless otherwise indicated.

Example 1

In this example, the test panel is precoated with the treating agent, anodized and then coated with the liquid fatty acid.

A series of degreased panels (3"×10"×0.040") of 2024T-3 aluminum were anodized in a 35° F. bath comprising 20% sulfuric acid, 2% oxalic acid, balance water, to a 0.5 mil thickness of anodized coating, rinsed and dried. The panels were promptly immersed in room temperature liquid isostearic acid, within 60 minutes, the isostearic acid being dosed with 5% by weight benzotriazole, left immersed for 5 minutes, withdrawn and wiped dry. The protected surface was tested in a salt spray per ASTM B-117-90.

Showing corrosion was defined as five or more pits per panel in accordance with military specification MIL-A-862SE. No showing of corrosion.(no pits) was detected after 1500 hours, when the test was discontinued. For comparison, panels only anodized showed corrosion after only 48 hours of salt spray testing. Panels anodized and treated with benzotriazole-5-carboxylic acid, but not subsequently coated with the fatty acid resisted showing corrosion for 72 hours of salt spray.

It will be seen therefore, that there is a large and synergistic improvement in the corrosion resistance of the test aluminum panels where both the noted treating agent and a fatty acid is employed.

It is also noteworthy that an effective protective coating on the panels was achieved without the use of environmentally-damaging chromates in the anodizing bath.

Example 2

Additional panels were anodized in 20% sulfuric at 29° C. to a thickness of 0.25 mil. The anodized panels were immersed in liquid isostearic acid within 6 hours of anodizing. Again the fatty acid contained 5% benzotriazole. Immersion was for 5 minutes, after which the panels were wiped dry and sent to salt spray testing. All panels showed an absence of corrosion for in excess of 1000 hours.

Example 3

The procedure of Example 2 was followed, but using only 1% benzotriazole in the isostearic acid. All panels showed an absence of corrosion at 1500 hours.

Example 4

The procedure of Example 2 was followed using 0.1% benzotriazole in isostearic acid. Some pitting was noted at 1008 hours and the test was discontinued.

CONTROL I

The procedure of Example 2 was followed, but the sample was sealed in boiling nickel acetate solution. Extensive corrosion of the panels was noted at 168 hrs.

CONTROL II

The procedure of Example 2 was followed, except that the panels were not first anodized before sealing. Extensive corrosion was noted at 72 hrs.

There is thus provided a versatile and highly effective means of enhancing the corrosion resistance of aluminum surfaces including surfaces of the copper-containing aluminum alloys.

I claim:

1. Method of increasing the resistance of a freshly anodized aluminum surface comprising coating said surface, without the use of organic solvents before or during coating, with a fatty acid which is liquid at coating application temperatures, said temperatures ranging from about 15° to 35° C.

2. The method of claim 1, including selecting a copper containing aluminum alloy of the 1000, 2000, or 7000 series.

3. The method of claim 1, including anodizing said aluminum surface to an anodize layer thickness of 0.2 to 0.6 mils.

4. The method of claim 1, in which said aluminum surface undergoes fatty acid application within 18 hours of anodizing.

5. The method of claim 1, in which said fatty acid is 100% fatty acid solids when applied.

6. The method of claim 1, including also selecting branch chain isostearic acid as said fatty acid.

7. The method of claim 6, including selecting a copper containing aluminum alloy of the 1000, 2000, or 7000 series as said aluminum surface.

8. The method of claim 7, including anodizing said aluminum surface to an anodize layer thickness of 0.2 to 0.6 mils.

9. The method of claim 8, in which said aluminum surface undergoes fatty acid application within 18 hours of anodizing.

10. The method of claim 9, including also spraying or dipping said aluminum surface with said fatty acid.

11. The method of claim 10, in which said fatty acid is 100% fatty acid solids when applied.

12. The method of claim 10, in which said fatty acid is free of organic solvents of higher flammability than said acid when applied.

13. Method of protecting copper alloys of aluminum against surface corrosion comprising the steps of anodizing the aluminum surface, treating said anodized surface before, during or after said anodizing step, with a heterocyclic aromatic azole treating agent having up to 16 carbon atoms and coating said anodized, treated surface, without the use of organic solvents before or during coating, with a fatty acid which is liquid at coating application temperatures, said temperatures ranging from about 15° to 35° C.

14. The method of claim 13, including selecting benzotriazole as said treating agent.

15. The method of claim 14, including treating said aluminum surface with a solution of said treating agent in said liquid fatty acid.

16. The method of claim 15, including maintaining from 0.1% to 10% by weight treating agent in said liquid fatty acid.

17. The method of claim 13, including treating said anodized surface with an organic solution of said treating agent after said anodizing step.

18. The method of claim 13, including simultaneously treating said anodized surface with treating agent and coating said surface with said liquid fatty acid, said treating agent being in solution in said liquid fatty acid.

19. The method of claim 13, in which said treating agent is benzotriazole and said liquid fatty acid is branched isostearic acid, said treating agent being present in an amount between 0.1% by weight and saturation.

20. Method of protecting series 1000, 2000, and 7000 copper-containing alloys of aluminum against surface corrosion comprising coating said alloy with a fatty acid, without the use of organic solvents before or during coating, said surface being previously or simultaneously treated with a heterocyclic aromatic azole treating agent having up to 16 carbon atoms.

21. The method according to claim 20, in which said liquid fatty acid is branched isostearic acid, said treating agent is benzotriazole and is present in an amount between 0.1% and 10% by weight in said isostearic acid.

22. The method according to claim 21, in which the aluminum surface anodize coat thickness is between 0.2 and 0.6 mils.

* * * * *